United States Patent [19]

Keefe, Jr.

[11] Patent Number: 4,914,902

[45] Date of Patent: Apr. 10, 1990

[54] HIGH STRENGTH CORED CORDS

[75] Inventor: Robert L. Keefe, Jr., Chadsford, Pa.

[73] Assignee: E. I. Du Pont de Nemours and Company, Wilmington, Del.

[21] Appl. No.: 324,531

[22] Filed: Mar. 14, 1989

[51] Int. Cl.[4] ..... D02G 3/48; D02G 3/02; D02G 3/36; B60C 9/00

[52] U.S. Cl. ..... 57/210; 57/231; 57/902; 152/451; 152/527; 152/556; 152/557

[58] Field of Search ..... 57/210, 211, 229, 231, 57/902, 903; 152/451, 527, 556, 557

[56] References Cited

U.S. PATENT DOCUMENTS

| | | | |
|---|---|---|---|
| 2,755,214 | 7/1956 | Lyons et al. | 57/902 X |
| 2,882,675 | 4/1959 | Tingas | 57/75 |
| 3,481,134 | 12/1969 | Whewell, Jr. | 57/12 X |
| 3,486,546 | 12/1969 | Sidles et al. | 57/902 X |
| 3,540,512 | 11/1970 | Helmovics, Jr. et al. | |
| 4,176,705 | 12/1979 | Russell et al. | 57/220 X |
| 4,392,341 | 7/1983 | Grill | 57/90 |
| 4,488,587 | 12/1984 | Umezawa et al. | 57/902 X |
| 4,572,264 | 2/1986 | Umezawa et al. | 152/451 |
| 4,651,513 | 3/1987 | Dambre | 152/527 X |
| 4,818,631 | 4/1989 | Bourgois | 152/527 X |
| 4,829,760 | 5/1989 | Dambre | 57/902 X |
| 4,832,101 | 5/1989 | Welter | 152/527 |

FOREIGN PATENT DOCUMENTS 1535105 12/1978 United Kingdom .

OTHER PUBLICATIONS

ASTM Part 24, D885, Appendix, p. 177 (1966) 1966 Book of ASTM Standards.

*Primary Examiner*—John Petrakes

[57] ABSTRACT

Very high strength cords are made and described which are composed of a core and a sheath of twisted yarns plied around the core in such a way that the cord exhibits greatly improved retained strength after use.

6 Claims, 2 Drawing Sheets

HIGH STRENGTH CORED CORDS

BACKGROUND OF THE INVENTION

1. Field of the Invention

This invention relates to very high strength cords composed of a core and a sheath of twisted yarns plied around the core in such a way that the cord exhibits greatly improved retained strength after use. The twisted yarns are generally made from aramid fibers; and are usually made from para-aramid fibers.

2. Description of the Prior Art

U.S. Pat. No. 4,392,341, issued July 12, 1983 on the application of Grill, discloses an apparatus and process for twisting several yarns and plying them to make cords. The apparatus is said to be specially suited to use with aramid yarns and utilizes a plate with equidistant holes for each yarn to serve as a thread guide. There is no teaching of a core/sheath structure.

U.S. Pat. No. 2,882,675, issued Apr. 21, 1959 on the application of Tingas, discloses a device for twisting and plying yarns to make cords. There is disclosure of a guide plate having several holes equidistant from one another and having a hole in the center. There is no disclosure of plying several yarns about a central yarn.

U.S. Pat. No. 3,481,134 issued Dec. 2, 1969, on the application of Whewell discloses a process for eliminating kinks in a core/sheath cord structure by means of twisting the core yarn in an opposite direction from the twist of the sheath yarns and twisting the overall cord structure in the same direction as the core yarn. The reference is directed to multi-ply cords having a core the same size as the yarns of the sheath. The relationship between core and ply yarns is completely outside the formulae of the present invention.

U.S. Pat. No. 4,176,705 issued Dec. 4, 1979 on the application of Russell et al., discloses a composite cord having a core of aramid wrapped by six steel strands. The steel strands are said to be slightly smaller than the aramid core so that the steel strands will be held slightly apart. The core is aramid because it has a load carrying tensile strength.

U.S. Pat. No. 2,755,214 issued July 17, 1956, on the application of Lyons et al., discloses preparation of cords having a nylon or polyester core with a sheath of twisted low modulus rayon yarns about the core. This reference is devoted to improving the creep character of low modulus rayon yarns and there is no recognition of any loss of cord strength due to compression fatigue in high modulus yarns.

SUMMARY OF THE INVENTION

The present invention provides a cord with a core yarn and a plurality of ply yarns equally spaced around the core yarn to form a sheath, wherein the core yarn and the ply yarns are made from a multitude of filaments and wherein the size of the core yarn and the ply yarns is such that the diameter of the core yarn is no smaller than the diameter of a circle with an area equal to the space formed at the center of a symmetrically-spaced arrangement of the ply yarns, and the diameter of the core yarn is no larger than the diameter of a circle which is formed by connecting points of contact from yarn-to-yarn in a symmetrically-spaced arrangement of ply yarns; both corrected for displacement and migration of ply yarns in the cord manufacture. The cords of this invention always have a core and may have from three to nine or more ply yarns.

Cords having the above-described core-ply size relationships exhibit greatly increased retained strength after use. Cords may from high modulus fibers are especially benefited by the relationship of the present invention.

The present invention provides such a cord coated with polymeric materials for various purposes and termed "dipped cord".

DETAILED DESCRIPTION OF THE INVENTION

Figure 1:
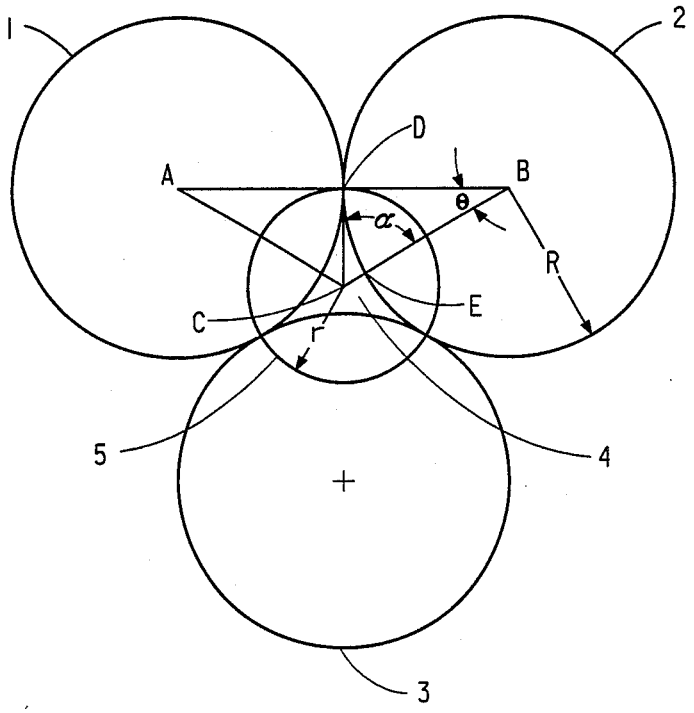
FIGS. 1 and 2 are geometric illustrations for determining the limits for core yarns in accordance with this invention.

In many industrial applications, there is a need for fibers which exhibit a high strength, when new, at the same time that they exhibit a capability to maintain a very high retained strength after use under extreme conditions. In fact, the need for a high strength when new is a relatively simple need which is satisfied if the fiber in question is strong enough to survive the stresses and strains of processing to manufacture whatever product will use the fibers. The critical test comes in the use of the fiber after it has been determined that a the fiber has enough strength to serve its intended purpose.

In fiber applications, such as in tire walls or belting, one of the most important fiber strength qualities is the strength which will be retained after use of the fiber, such as after use of the tires or beltings which incorporate the fiber. By means of the present invention, there has been found a means for greatly improving that retained strength while maintaining an adequate high strength when new.

It has been found that cords can be much improved as to overall strength after use by insertion of a core yarn at the center of the surrounding sheath of ply yarns.

Moreover, it has been found that there is a certain relationship between the cross-sectional area of the core yarn and the cross-sectional area of the ply yarns in the cord structure. When the core cross-section is too small, the strength of the cord, when new, is high but the retained strength after use is about the same as an uncored structure. When the core cross-section is too large, the strength of the cord, when new, is much diminished and the retained strength after use is less than would be exhibited by an uncored structure. When the core cross-section is within the acceptable size range identified by this invention, the strength of the cord, when new, is only slightly diminished and the retained strength after use is far greater than would have been expected. The term "ply" refers to an individual yarn which is twisted together with other plies to yield a complete structure. In the case of a complete structure which has a core, the ply yarns are only the yarns which are twisted around the core.

In yarns of material having high modulus, such as greater than about 200 grams per denier, there is a severe tendency for strength loss in use. High modulus fibers of organic polymeric materials suffer serious strength loss in use due to compression fatigue. The kernel of this invention resides in the discovery that cords made from ply yarns of such high modulus organic polymeric materials and including core yarns for spacing purposes exhibit a surprisingly improved resistance to fatigue loss.

Plies of this invention are generally any yarns having a multitude of filaments made from high modulus synthetic organic materials, especially aromatic polyamides. Aromatic polyamides are known as aramids and the preferred aramid is poly(p-phenylene terephthalamide) (PPD-T). The ply yarns usually include from 100 to as many as 2000 or 3000 individual filaments. Poly(p-phenylene terephthalamide) means the homopolymer resulting from mole-for-mole polymerization of p-phenylene diamine and terephthaloyl chloride and, also, copolymers resulting from incorporation of small amounts of other aromatic diamine with the p-phenylene diamine and of small amounts of other aromatic diacid chloride with the terephthaloyl chloride. As a general rule, other diamines and aromatic diamines and other diacid chlorides and aromatic diacid chlorides can be used in amounts up to as much as about 10 mole percent of the p-phenylene diamine or the terephthaloyl chloride, or perhaps slightly higher, provided only that the other amines and acid chlorides have no reactive groups which interfere with the polymerization reaction or inordinately after the qualities of the polymer. It is understood that poly(p-phenylene terephthalamide) fibers which include such small amounts of other amines and acids may exhibit physical properties slightly different from those which would have been obtained had no other diamines or acids been present.

The term "core" refers to a yarn which is located in the center of a complete structure. Cores of this invention are generally yarns having a multitude of filaments made from a variety of polymeric materials. The yarns usually include from 10 to 1500 individual filaments. The core fibers should have a multitude of filaments to provide conformability and appropriate handling character during the cord twisting processes. The cores can be made from any fiber material, natural or synthetic. Preferred materials include aromatic polyamides, polyesters, rayon, nylon, and the like.

The term "cord" refers to a complete structure made up of twisted plies and, if appropriate, a core. The number of plies in a cord can range from three to nine or more. In cord construction, the individual yarns—plies and core—are, generally, twisted; and then those yarns are twisted together to make the cord. In the twisting together, the plies and the core are subjected to tension in some degree and the plies are subjected to twist which is opposite to that of the cord. In practice of this invention, it has been found that the degree of tension is important when the core is relatively small to assure that the core yarn remains straight during the cord assembly. As a general rule, the individual yarns are twisted in one direction and, then, they are twisted together in the opposite direction. When a yarn or cord is viewed from the side, the twist is said to be a "Z" twist if the individual yarn or cord elements appear to go down from right to left. On the other hand, the twist is said to be an "S" twist if the individual yarn or cord elements appear to go down from left to right.

In constructing the cored cords of the present invention, it has been found important to place a pretwist in the core yarn, before cord construction. That is, the core yarn should have a twist before it is introduced to the cording apparatus; and that twist should be in the direction opposite from the final twist of the cord. The degree of core pretwist should be such that the final twist on the core in the finished cord is relatively low. In cord construction, while the ply yarns are being twisted around the core there is a tendency for the core yarn to be twisted, also. The core yarn pretwist should be such as to counteract the twist incurred during cord construction.

For all cores, in general, and especially for cores near the upper limit for the core size, it is important to construct the cord in such a way that the core yarn has a twist from 5z to 5s, with zero twist preferred. Core yarns with only a small degree of twist are more able to conform to the shapes required for most efficient spacing in the cord construction.

The term "dipped cord" refers to a cord which has been coated with polymeric materials designed to increase adhesion of the cord to matrices such as rubber, as might be encountered in tire construction. In the most usual case, cords are dipped in coating compositions while under some degree of tension; and, then, are dried for further processing. There is usually more than one coat; and the coatings are selected from among a wide variety of materials including epoxies, isocyanates, and various resorcinol-formaldehyde latex mixtures.

Cords, once dipped, are generally cured into some other structure such as a rubber tire or fiber-reinforced belting.

A variety of sizes of core yarns and ply yarns can be used to make cored cords. As previously mentioned, the present invention is concerned with a critical relationship between cross-sectional areas of the cores and the plies in a cored structure. It has been determined that a core can be inserted into a cord to serve as a spacer for the plies and that such a core, when of the correct size, increases the retained strength of the cord after extensive flexing; and does not unduly reduce the strength when new.

It has been determined that the core yarn serves as a spacing element in the cored cord construction of this invention and that the core adds little or no benefit to the cord if the cross-sectional area of the core is smaller than the space at the center of a symmetrically-spaced arrangement of ply yarns. Moreover, if the core is too large, there is a tendency for the core to come out of the cord construction and cause kinking and irregularities in the shape of the cord. A core which is too large causes a severe decrease in the retained strength of the cord after flexing. It has been determined that the core should not be larger than the circle which is subtended by the points of contact from yarn-to-yarn in a symmetrically-spaced arrangement of ply yarns. Both, the minimum core size and the maximum core size should be corrected for displacement and migration of filaments in the cord manufacture.

Because the core and the ply yarns are somewhat flexible and because individual filaments may be displaced or migrate during cord manufacture, it has been determined that, as a practical matter, the minimum core size should be slightly larger than the area of the space at the center of the ply yarns and the maximum core size should be slightly larger than the circle which is subtended by the points of contact from ply yarn to ply yarn. It has been determined that as much as 25% adjustment is necessary in the radius of the core cords to allow for displacement and migration of individual filaments during the cord manufacture. The adjustment is made to, both, the upper and the lower limits.

Looking to FIG. 1, there is a simplified representation of a three-ply cord made up of plies 1, 2, and 3, having radii R. The plies, when in mutual contact, leave a central space 4 of generally triangular shape with curved sides. Also, when the plies are in mutual contact, the yarn-to-yarn points of contact delineate a circle 5 with radius r. Therefore, for a cord having three plies with radii R, the minimum radius for the core yarn ($r_{min}$) has been determined to be that radius which yields a circle with area equal to the central space 4; and the maximum radius for the core yarn ($r_{max}$) has been determined to be a more complicated function of the number and radius of the ply yarns (R); both, adjusted for displacement and migration of filaments.

To determine the relationship between the ply radius and the minimum core radius in FIG. 1, it is noted that the angle DBC is thirty degrees and that DBC is a right triangle.

The area of triangle DBC is $\frac{1}{2}$(DB)(CD); (DB) equals R; and (CD) equals (DB) Tan $\theta$. The area of sector DBE is $(30/360)\pi(R)^2$. The portion DEC of the central space is the area of triangle DBC minus the area of sector DBE:

$$[(\tfrac{1}{2})(R)(R)(\text{Tan } 30)]-[(30/360)\pi(R)^2]$$

$$R^2[(\tfrac{1}{2})(\text{Tan } 30)-(1/12)\pi]$$

The area of the entire central space is six times the portion DEC, above, as follows:

$$R^2[3 \text{ Tan } 30-\pi/2]=R^2(0.1613)$$

and the radius for a circle with that area is:

$$r_{min} = R\sqrt{\frac{(0.1613)}{\pi}} = R(0.2266)$$

To determine the relationship between the ply radius and the maximum core radius, it is noted that the length of CD is r. The Tan $\theta$=CD/DB=r/R. Solving for r, provides the following relationship for the circle which joins points of contact between adjacent ply yarns:

$$r_{max}=R(\text{Tan } \theta)=R(0.577)$$

Figure 2:
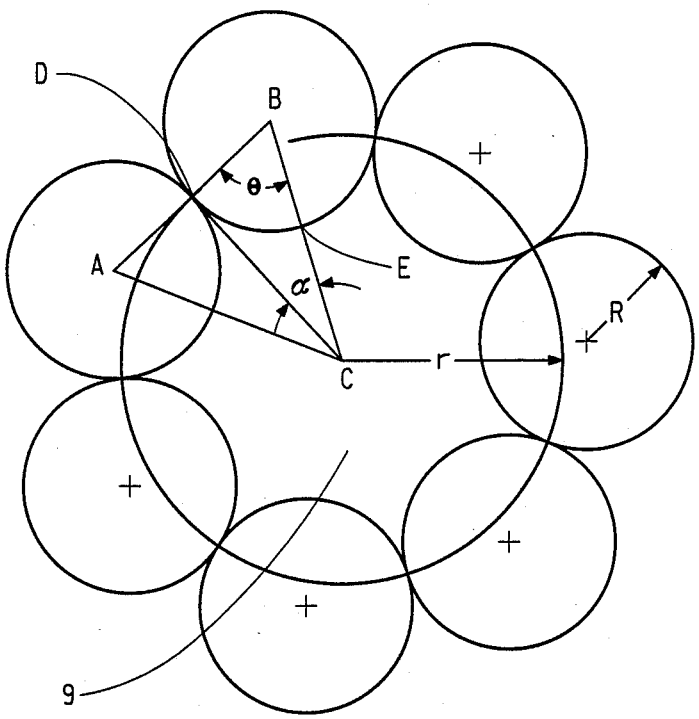

For a more general application, FIG. 2 is a simplified representation of a cord made up of n plies of yarn, each having radius R. The plies, when in mutual contact, leave a central space 9. Also, when the plies are in mutual contact, the yarn-to-yarn points of contact delineate a circle with radius r. The minimum core radius is the corrected radius of a circle having an area the size of the central space 9 and the maximum core radius is the corrected radius of the circle delineated by the yarn-to-yarn points of contact, r.

To determine the minimum core radius in a cord of n plies, the area of triangle DBC is:

$$\begin{aligned} A_{DBC} &= (\tfrac{1}{2})(DB)(CD) = (\tfrac{1}{2})(R)(R\text{Tan } \Theta) \\ &= \tfrac{1}{2} R^2\text{Tan}\left(90 - \frac{180}{n}\right) = \frac{R^2}{2} \text{ Tan } \left(90 - \frac{180}{n}\right) \end{aligned}$$

where $$\theta=90-\alpha \text{and}$$

$$\alpha=180/n$$

The area of the sector DBE is:

$$\begin{aligned} A_{DBE} &= \pi R^2\left(\frac{\Theta}{360}\right) \\ &= \pi R^2\left[\frac{90-(180/n)}{360}\right] = \pi R^2\left[\frac{90n-180}{360n}\right] \\ &= \pi R^2\left(\frac{n-2}{4n}\right) \end{aligned}$$

The area of an entire central space for a cord of n plies is:

$$\begin{aligned} A_n &= 2n(A_{DBC} - A_{DBE}) \\ &= 2n\left[\frac{R^2}{2} \text{ Tan}\left(90 - \frac{180}{n}\right) - \pi R^2\left(\frac{n-2}{4n}\right)\right] \end{aligned}$$

and the radius for such a circle with that area is:

$$r = \sqrt{A_n/\pi}$$

$$r = R\sqrt{\frac{n}{\pi} \text{ Tan}\left(90 - \frac{180}{n}\right) - \left(\frac{n-2}{2}\right)}$$

The radius of a circle subtending the points of yarn-to-yarn contact for a cord of n plies is:

$$r = R(\text{Tan } \Theta) = R\left[\text{Tan}\left(90 - \frac{180}{n}\right)\right]; \text{ and}$$

$$r = R\left[\text{Tan}\left(90 - \frac{180}{n}\right)\right].$$

The general core size relationships are, therefore, as follow:

$$r_{core} > R\left[\frac{n}{\pi} \text{ Tan}\left(90 - \frac{180}{n}\right) - \left(\frac{n-2}{2}\right)\right]^{\frac{1}{2}} [125\%]$$

$$r_{core} < R\left[\text{Tan } (90 - \frac{180}{n}\right][125\%]$$

wherein r is the radius of the core yarn

R is the radius of the ply yarn n is the number of ply yarns in the cord and

125% is the adjustment for displacement and migration of individual filaments.

From the above analysis, it is seen that the limits of acceptable core sizes can be easily calculated using the size, kind, and number of ply yarns and the kind of core yarn.

To determine the cross sectional area relationships of the various yarns, the denier of the yarns must be known, as well as the density of the polymeric material from which the yarns are made.

A 3000 denier yarn of poly(p-phenylene terephthalamide) has a radius of about 0.325 mm (12.8 mils) and a cross sectional area of about 0.332 $mm^2$ (515 $mils^2$).

Using a three-ply cord of such yarn as an example for calculation purposes, $$r_{core} > R(0.226)(125\%) = R(0.283) = 0.0920 \text{ mm}$$

$$r_{core} < R(0.577)(125\%) = R(0.722) = 0.234 \text{ mm}$$

Based on the determination that a 3000 denier yarn of poly(p-phenylene terephthalamide) has a radius of 0.325 mm and a cross sectional area of 0.332 mm$^2$, the following characteristics can be determined for a variety of core yarns made from different materials:

| yarn material | density (g/cc) | corrected areal denier (denier/mm$^2$) |
|---|---|---|
| PPD-T | 1.44 | 9040 |
| rayon | 1.38 | 8660 |
| polyester | 1.38 | 8660 |
| nylon | 1.14 | 7150 |

Using the core radius equations and the areal denier for the above materials, the following core radii and deniers can be determined for a cord having three plies of 3000 denier poly(p-phenylene terephthalamide):

| | Maximum | | | Minimum | | |
|---|---|---|---|---|---|---|
| Core material | r (mm) | Area (mm$^2$) | den. | r (mm) | Area (mm$^2$) | den. |
| PPD-T | 0.234 | 0.172 | 1555 | 0.092 | 0.0266 | 240 |
| rayon | | | 1490 | | | 230 |
| polyester | | | 1490 | | | 230 |
| nylon | | | 1230 | | | 190 |

Test Methods

Denier.

The denier of a yarn is determined by weighing a known length of the yarn. Denier is defined as the weight, in grams, of 9000 meters of the yarn. Multiplication of denier by 1.111 yields linear density of the yarn in dtex.

Tensile Properties.

Tenacity is reported as breaking stress divided by linear density. Modulus is reported as the slope of the initial stress/strain curve converted to the same units as tenacity. Elongation is the percent increase in length at break. Both tenacity and modulus are first computed in g/denier uints which, when multiplied by 0.8826, yield dN/tex units. Each reported measurement is the average of 10 breaks.

Yarns tested for tensile properties are measured at 24° C. and 55% relative humidity after conditioning under the test conditions for a minimum of 14 hours. Before testing, each yarn is twisted to a 1.1 twist multiplier. The twist multiplier (TM) correlates twist per unit of length with linear density of a yarn being twisted. It is computed from $$TM = (\text{Denier})^{\frac{1}{2}}(\text{tpi})/73 \text{ where tpi} = \text{turns/inch}$$

$$TM = (\text{dtex})^{\frac{1}{2}}(\text{tpc})/30.3 \text{ where tpc} = \text{turns/cm.}$$

Each twisted specimen has a test length of 25.4 cm and is elongated 50% per minute (based on the original unstretched length) using a typical recording stress/-strain device.

Flex test (Disk Fatigue).

The primary means for determining the retained strength of used cords is through a test described in the ASTM Standards to test Fatigue Resistance. Fatigue Resistance can be thought of as the ability of a cord to resist degradation when it is forced to undergo repeated cycles of stress, such as compression.

To conduct Fatigue Resistance testing, yarns to be tested are twisted and dipped and the dip coatings are cured. The dip coated cords are, then, cured in rubber and subjected to a disk fatigue test as described in ASTM Part 24, Appendix, page 177 (1966).

The test exposes a cord embedded in rubber to cyclic tensioning and/or compression to measure the effect of the fatigue on the properties of the cord. The Disc Fatigue Tester is an instrument developed and patented (U.S. Pat. No. 2,595,069) by B. F. Goodrich Company. It comprises two facing disks which rotate about axes which meet at a small angle so that a specimen mounted to and between the disks, with each end of the cord substantially perpendicular to one of the disk faces, will change in length as the disks rotate on their axes at the same angular velocity. The results of this test are sensitive to the modulus of the rubber stock used, to the spacing and angle between the disks of the testing machine, and to the number of cords in the rubber block for each specimen. For the testing herein, there is one cord-length per block, and it is subjected only to compression.

Yarns to be tested are placed on a twisting machine and are twisted in one direction, usually to achieve a "Z" twist. The twisted yarns are twisted together in the opposite direction to yield a complete cord structure. The resulting cord is, then, dipped into a subcoat bath and the subcoating is cured for 1 minute at 243° C. The subcoated cords are dipped in a bath of topcoating composition and that topcoating is cured at 232° C. for 1 minute. Although subcoatings and topcoatings for assuring good adhesion to rubber are well known and any kind of subcoating and topcoating materials can be used which assure effective adhesion to rubber or whatever matrix will be with the cords, the materials used herein are as follow: For the subcoating, the formulation identified as IPD-31 in Table II of "Technical Symposiums", Akron Rubber Group, Inc., 1977–1978, page 111. In that formulation, 0.37 parts of $NaCO_3$ can be used to replace 0.28 parts of NaOH. For the topcoating, the formulation identified as PFR-1 in Table IV of the aforementioned "Technical Symposiums", with addition of 11.92 parts of a wax identified as Heveamul-M-111B (45% solids) (sold by Heveatec Corp. of Fall River, MA, USA) to further increase adhesion. The wax can be added with the Black Dispersion and after the aging step; and the amount of water in the formula is reduced by the amount of water added with the wax dispersion.

The topcoated cords are cured into a rubber composition as follows:

The rubber stock employed herein is composed of:

| | |
|---|---|
| Natural Rubber (RSS#1) (pts. by weight) | 80 |
| SBR 1500 (styrene butadiene rubber) | 20 |
| N351 Carbon black | 35 |
| "Para-Flux"* | 4 |
| Stearic acid | 2 |
| Zinc oxide | 5 |
| "NOBS" Special** | 1.25 |
| Diphene Resin 8318*** | 2.0 |
| "Agerite" Resin D**** | 1.0 |
| "Crystex" 20% Oiled Insoluble Rubber | 3.1 |

-continued

| | |
|---|---|
| | 153.35 |

*saturated polymerized petroleum hydrocarbon (C. P. Hall Company).
**N—oxydiethylenebenzothiazole-2-sulfenamide (American Cyanamid Co.)
***octylphenol formaldehyde (Summit Chemical Co.)
****polymerized trimethyldihydroquinoline (R. T. Vanderbilt Co., Inc.)

This rubber stock, when calendered to 0.075 in (1.90 mm) thick and cured at 160° C. for 20 min, must exhibit a 300% modulus of 1250–1550 psi (8.62–10.69 MPa).

Each specimen for testing has two layers of rubber stock shaped to slightly more than fill the curing mold of the tester with a single cord positioned lengthwise between them. The mold is shaped to provide specimens as described, below. The excess stock flows out the yarn-guide openings at the ends of the mold during curing so that the cords remain straight and free of compression. The length of each specimen as mounted between the disks is 1.000 in (25.4 mm), but each must be cut and molded with suitable end extensions to fit the mounting devices of the tester used. A 100 g weight is hung on the cord loop during curing. The rubber stock is cured at 150° C.±2° C. for 40 min. The cured rubber is cooled before the tensioning weights are removed; and the samples are stored in desiccated air for at least 8 hr before testing. Sample specimens, in all of the part subjected to fatigue, are 0.5 in (1.27 cm) wide and 0.438 in (11.11 mm) thick.

The yarns, once cured into rubber blocks, are mounted as test specimens on the periphery of the disks in a Disk Fatigue Tester such as the above-identified B. F. Goodrich disk fatigue testing machine sold by the Ferry Machine Co., Kent, Ohio.

The disks normally accommodate several specimens simultaneously. Each specimen is mounted between the disks precisely where the disks are separated by exactly one inch (their maximum separation). The disks have been previously adjusted so that a maximum of 15% compression will occur during testing (minimum spacing between disks of 0.850 in (21.59 mm)). The atmosphere where testing is carried out is at 75° F. (24° C.). Testing is for 6 hr at a rate of 2700±30 rpm. Specimens are removed from the disks at the 1.000 in (25.4 mm) separation point before they have had opportunity to cool down. Each is soaked in perchloroethylene at 70° C. for 16 hr. A few minutes after removal from this bath, to allow excess solvent to drip off, each cord is carefully pulled out of the swollen rubber. Breaking strengths are measured after conditioning for 48 hr in 55±2% RH and 75±2° F. (24±1° C.). Sample lengths between clamps are 10 in (25.4 cm), rate of extension is 50 percent/min, only Instron-type "4D" clamps are used, and breaking strength is accepted only if the break occurs within the one-inch fatigued length of the cord.

DESCRIPTION OF THE PREFERRED EMBODIMENTS

EXAMPLE 1

For an example of this invention, several cords were made inserting a variety of kinds and sizes of core yarns into a three-ply cord of poly(p-phenylene terephthalamide) yarns. The ply yarns were 3000–1333 R80–950 merge IF213 commercially-available and sold by E. I. du Pont de Nemours & Co. under the tradename "Kevlar".

The ply yarns were 3000 denier, 1333 filament with a 5z twist (5 turns per inch) prior to cording and were corded at about 5s (5 turns per inch) to achieve a dipped cord twist multiplier of 6.5 to 7.2. The core yarns were selected from nylon (6,6), poly(p-phenylene terephthalamide), polyester (polyethylene terephthalate), and rayon.

Using the equations previously-derived from this invention, the useful core size ranges for the above-noted ply yarns and the above-noted core kinds are as follows:

| Material | Minimum denier | Maximum denier |
|---|---|---|
| Nylon | 190 | 1230 |
| p-aramid | 240 | 1550 |
| polyester | 230 | 1490 |
| rayon | 230 | 1490 |

The test cords were twisted using each of the above-named cores and using cores in a variety of sizes and degrees of core yarn twist.

The test cords were provided with a subcoat and a topcoat according to the procedure described above under the Test Method for Disk Fatigue. The coated cords were then embedded in the rubber composition; and test specimens were prepared from the resulting rubber blocks, all as described above. The test specimens were placed on disk fatigue test wherein the specimens were subjected to cycles of 15% compression tension for six hours under the conditions of test as set out above and in ASTM, Part 24, D 885, Tests for Tire Cords from Man-Made Fibers, page 177 et seq. Control cord of ply yarns with no core was, also, subjected to the disk fatigue testing.

Cords were removed from the rubber blocks for tensile testing. The results of the tests are set out in the tables below. Table 1 shows the unused tenacities of dipped cords of this invention with a variety of core yarns; and Table 2 shows a comparison of the retained strengths (after disk fatigue test) of cords with and without core yarns. Note that Disk Fatigue Efficiency is found by dividing the break strength of a cored cord after disk fatigue testing by the break strengh of an uncored cord after the same disk fatigue testing and multiplying by 100.

TABLE 1

DIPPED CORD TENACITY (grams per denier)

| Core Material | Core Pretwist 10z | 5z | 1z | 5s |
|---|---|---|---|---|
| Control (No core) | 18.4 | 18.4 | 18.4 | 18.4 |
| Nylon | | | | |
| 210 denier | 17.4 | 17.6 | 17.5 | 17.3 |
| 420 denier | 16.5 | 16.8 | 16.6 | 16.5 |
| 630 denier | 15.9 | 16.1 | 16.1 | 16.1 |
| 840 denier | 14.9 | 14.7 | 15.2 | 13.6 |
| 1260 denier | 13.9** | 15.0** | 14.4 | 11.3 |
| 1890 denier | 12.4** | 13.7** | 13.2* | 10.3* |
| p-aramid | | | | |
| 400 denier | 17.3 | 17.7 | 17.5 | 17.4 |
| 1000 denier | 15.3 | 16.2 | 16.0 | 15.0 |
| polyester | | | | |
| 1000 denier | 14.0 | 16.1 | 15.8 | 14.0 |
| rayon | | | | |
| 1100 denier | 15.4 | 14.9 | 15.0 | 15.2 |

*Gaps appeared between the plies indicating that the core was too large.
**The core popped out of the ply sheath and kinked.

TABLE 2

DISK FATIGUE EFFICIENCY

| Core Material | Core Pretwist 10z | 5z | 1z | 5s |
|---|---|---|---|---|
| Control (No core) | 100 (202 pounds break strength) | | | |
| Nylon | | | | |
| 210 denier | 110 | 107[1] | 117 | 114 |
| 210 denier | — | 127[2] | — | — |
| 420 denier | 131 | 139 | 132 | 138 |
| 630 denier | 148 | 141 | 146 | 144 |
| 840 denier | 148 | 157 | 150 | 148 |
| 1260 denier | 79** | 129** | 145 | 127 |
| 1890 denier | 82** | 123** | 144* | 139* |
| p-aramid | | | | |
| 400 denier | 120 | 115 | 102 | 135 |
| 1000 denier | 126 | 126 | 130 | 142 |
| polyester | | | | |
| 1000 denier | 133 | 153 | 155 | 147 |
| rayon | | | | |
| 1100 denier | 145 | 142 | 138 | 153 |

[1]Core Tension was 60 grams during cord construction.
[2]Core Tension was 150 grams during cord construction.
*Gaps appeared between the plies indicating that the core was too large.
**The core popped out of the ply sheath and kinked.

I claim:

1. A cord comprising a core yarn and a plurality of ply yarns equally spaced around the core yarn to form a sheath, wherein:

(i) the core yarn is made from a multitude of filaments and has a radius, r;

(ii) each of the ply yarns are made from a multitude of filaments and have a radius, R; and (iii) the core yarn and the ply yarns are related in accordance with the following formulae $$r_{core} > R\left[\frac{n}{\pi}\,\mathrm{Tan}\left(90-\frac{180}{n}\right)-\left(\frac{n-2}{2}\right)\right]^{1/2}\ [125\%]$$

$$r_{core} < R\left[\mathrm{Tan}\left(90-\frac{180}{n}\right)\right][125\%]$$

wherein n is the number of ply yarns in the cord.

2. The cord of claims 1 wherein the core yarn has a twist of from 5z to 5s.

3. The cord of claim 1 wherein the ply yarns are made from aramid fibers.

4. The cord of claim 3 wherein the aramid fibers are para aramid fibers.

5. The cord of claims 1 wherein the ply yarns are made from aramid fibers having a modulus greater than 200 grams per denier.

6. The cord of claim 5 wherein the aramid fibers are poly(p-phenylene terephthalamide) fibers.

* * * * *